US007707949B2

(12) United States Patent
Larcom et al.

(10) Patent No.: US 7,707,949 B2
(45) Date of Patent: May 4, 2010

(54) FOLD-IN-HALF TABLE WITH PIVOTALLY ATTACHED LEG ASSEMBLIES

(75) Inventors: Larry Larcom, Roy, UT (US); David C. Winter, Layton, UT (US); Joel Bennett, Clinton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 12/126,615

(22) Filed: May 23, 2008

(65) Prior Publication Data

US 2008/0216719 A1 Sep. 11, 2008

Related U.S. Application Data

(63) Continuation of application No. 12/042,250, filed on Mar. 4, 2008.

(60) Provisional application No. 60/939,812, filed on May 23, 2007, provisional application No. 60/974,825, filed on Sep. 24, 2007.

(51) Int. Cl.
*A47B 3/083* (2006.01)

(52) U.S. Cl. ..... 108/169; 108/174; 108/132

(58) Field of Classification Search ..... 108/34, 108/35, 38, 36, 162, 166, 167, 168, 169, 108/171, 172, 173, 174, 115, 129, 132, 131, 108/130

See application file for complete search history.

(56) References Cited

U.S. PATENT DOCUMENTS 1,165,991 A 12/1915 Maggs
2,643,926 A 6/1953 Pucci
2,689,158 A 9/1954 Mahr
2,782,075 A * 2/1957 Fagan ..... 108/173
3,144,841 A * 8/1964 Meringoff ..... 108/173
3,357,729 A 12/1967 Krueger
3,635,432 A 1/1972 Hollander (Continued)

FOREIGN PATENT DOCUMENTS

GB 626807 7/1949

OTHER PUBLICATIONS

U.S. Appl. No. 11/051,933, filed Feb. 4, 2005, Haney.

(Continued)

*Primary Examiner*—José V Chen
(74) *Attorney, Agent, or Firm*—Workman Nydegger

(57) ABSTRACT

A table may include a table top with first and second sections that are connected by a hinge to allow the section to move between a folded position and an unfolded position. The table may also include legs that are movable between a use position and a storage position relative to the table top. The hinge may facilitate folding of the table top when the legs are in the storage position. On the other hand, the hinge may resist folding of the table top when the legs are in the extended position. In addition, the table may include components that expand and/or contract in different fashions in response to changes in temperature. For example, the table top and the frame may be constructed from different materials with different coefficients of expansion in response to temperature changes. The table is preferably sized and configured to accommodate these differences in expansion and contraction.

20 Claims, 11 Drawing Sheets

U.S. PATENT DOCUMENTS

| | | | | | |
|---|---|---|---|---|---|
| 3,718,306 | A | | 2/1973 | Murray | |
| 3,799,073 | A | | 3/1974 | Nielsen | |
| 4,120,249 | A | * | 10/1978 | Blink et al. | 108/174 |
| 4,133,271 | A | * | 1/1979 | Carlson | 108/174 |
| 4,759,296 | A | | 7/1988 | Simpson | |
| 5,014,628 | A | | 5/1991 | Roberts | |
| 5,271,338 | A | | 12/1993 | Bonham | |
| 5,311,825 | A | | 5/1994 | Bonham | |
| 5,345,881 | A | | 9/1994 | Loescher | |
| 5,623,882 | A | | 4/1997 | Price | |
| 5,636,578 | A | | 6/1997 | Rizzi | |
| 5,678,491 | A | | 10/1997 | Price et al. | |
| 5,694,865 | A | | 12/1997 | Raab | |
| 5,732,637 | A | | 3/1998 | Raab | |
| 5,868,081 | A | | 2/1999 | Raab | |
| 5,921,623 | A | | 7/1999 | Nye et al. | |
| 5,947,037 | A | | 9/1999 | Hornberger et al. | |
| 5,983,807 | A | | 11/1999 | Tarnay et al. | |
| 6,058,853 | A | | 5/2000 | Pinch | |
| 6,058,854 | A | | 5/2000 | Tarnay et al. | |
| 6,112,674 | A | | 9/2000 | Stanford | |
| 6,371,034 | B1 | | 4/2002 | Simpson et al. | |
| 6,520,094 | B2 | | 2/2003 | Wen | |
| 6,615,743 | B2 | | 9/2003 | Nien | |
| 6,622,644 | B2 | | 9/2003 | Buono | |
| 6,651,568 | B1 | | 11/2003 | Buono | |
| 6,694,897 | B2 | | 2/2004 | Lou-Hao | |
| D489,557 | S | | 5/2004 | Strong et al. | |
| 6,732,663 | B2 | | 5/2004 | Tsai | |
| 6,736,076 | B2 | | 5/2004 | Kaltenmark et al. | |
| 6,752,091 | B2 | | 6/2004 | Glover et al. | |
| 6,837,171 | B1 | | 1/2005 | Clark | |
| 6,877,441 | B2 | | 4/2005 | Zheng | |
| 6,905,166 | B2 | | 6/2005 | Zhurong et al. | |
| 6,915,748 | B2 | | 7/2005 | Stanford | |
| 7,111,563 | B2 | | 9/2006 | Strong | |
| 2003/0005864 | A1 | | 1/2003 | Wen | |
| 2003/0106474 | A1 | | 6/2003 | Buono | |
| 2003/0177962 | A1 | | 9/2003 | Stanford | |
| 2003/0233967 | A1 | | 12/2003 | Lin | |
| 2004/0031422 | A1 | | 2/2004 | Wong | |
| 2004/0094076 | A1 | | 5/2004 | Jin | |
| 2004/0244826 | A1 | | 12/2004 | Ashby | |
| 2004/0245425 | A1 | | 12/2004 | Noniewicz | |
| 2005/0160950 | A1 | | 7/2005 | Haney | |
| 2005/0241550 | A1 | | 11/2005 | Neunzert et al. | |
| 2005/0274304 | A1 | | 12/2005 | Strong | |
| 2006/0236902 | A1 | | 10/2006 | Haney | |

OTHER PUBLICATIONS

U.S. Appl. No. 11/373,582, filed Mar. 9, 2006, Haney et al.
U.S. Appl. No. 29/279,299, filed Apr. 25, 2007, Van Nimwegen et al.
U.S. Appl. No. 12/042,250, filed Mar. 4, 2008, Larcom.
Office Action dated Nov. 9, 2005 from U.S. Appl. No. 10/409,273, 4 pages.
Office Action dated Apr. 2, 2008 from U.S. Appl. No. 11/051,933, 6 pages.
Office Action dated Aug. 2, 2007 from U.S. Appl. No. 11/051,933, 5 pages.
U.S. Appl. No. 12/235,202, filed Sep. 22, 2008, Larcom.
International Preliminary Report onPatentability dated Sep. 17, 2009 from PCT/US2008/055878.
International Search Report and Written Opinion dated Jul. 28, 2008 from PCT/US2008/055878.

* cited by examiner

FOLD-IN-HALF TABLE WITH PIVOTALLY ATTACHED LEG ASSEMBLIES

CROSS-REFERENCE TO RELATED APPLICATIONS

This application is a continuation of U.S. patent application Ser. No. 12/042,250, filed on Mar. 4, 2008.

This application claims priority to, and the benefit of, U.S. provisional patent application No. 60/939,812, filed on May 23, 2007.

This application claims priority to, and the benefit of, U.S. provisional patent application No. 60/974,825, filed on Sep. 24, 2007.

These applications are incorporated by reference in their entireties.

BACKGROUND OF THE INVENTION

1. Field of the Invention

The present invention generally relates to tables.

2. Description of Related Art

Many different types of tables are well known and used for a variety of different purposes. For example, conventional tables may include legs that are pivotally attached to a table top and the legs may be movable between a use position in which the legs extend outwardly from the table top and a storage position in which the legs are folded against the table top. Conventional tables with relatively large table tops and folding legs are often referred to as "banquet tables" and these tables are frequently used in assembly halls, banquet halls, convention centers, hotels, schools, churches and other locations where large groups of people meet. Because these conventional tables are generally easy to move and relatively portable, these types of tables can often be positioned in an assortment of different configurations and used in a variety of settings. When the tables are no longer needed, the table legs can be moved into the storage position and the tables may be moved or stored.

Conventional banquet tables with collapsible legs may allow the table to be more conveniently stored. The table top for many conventional banquet tables with collapsible legs, however, retains its size and shape. For example, many known banquet tables have a length between six to ten feet and a width between three to four feet. As a result, the storage of many conventional banquet tables, even with the legs in the collapsed position, may require a large storage area. This large storage area for each table may be problematic for large facilities such as hotels, schools and churches because a considerable number of these table may have to be stored. Thus, even when the tables are stored with the legs in the collapsed position, a relatively large area may be required. In addition, many smaller facilities such as restaurants, offices and homes may use one or more conventional banquet tables. These smaller facilities may use the tables less frequently than the larger facilities, such as only during special occasions. Conventional banquet tables, however, are often too bulky and obstructive to be conveniently used and stored at such smaller facilities. As a result, it is often necessary for both larger and smaller facilities to rent and/or borrow banquet tables when needed. Disadvantageously, the process of renting and/or borrowing banquet tables can be inconvenient, time consuming and costly. For example, these conventional banquet tables may be difficult to carry, transport and move. In addition, these conventional banquet tables may be relatively heavy, which may increase the difficulty in carrying, transporting and moving the table.

In addition, conventional banquet tables are often very difficult to move or transport from one location to another because of the length of the table. Additionally, the length of the table may prevent a single person from easily moving the table and may require the use of two people to move the table. In addition, the extended length of the banquet tables may preclude the tables from being transported in the trunk or back seat of a typical passenger car. Accordingly, the banquet tables may have to be transported by a truck or trailer, which may be difficult to obtain, expensive and require a significant amount of time.

It is also known to construct tables with table tops that are capable of being folded-in-half Unfortunately, when conventional fold-in-half tables are in the unfolded or use position, the table tops may unintentionally fold, especially when carrying and/or moving the tables.

BRIEF SUMMARY OF EMBODIMENTS OF THE INVENTION

A need therefore exists for a table that reduces or eliminates the above-described and other disadvantages and problems.

One aspect is a table that may include a table top and one or more legs or support pedestals that may be sized and configured to support the table top in a use or support position. The legs or support pedestals are preferably movable between an extended or use position and a collapsed or storage position relative to the table top. Advantageously, when the legs or support pedestals are in the use position, the table may be used to support a wide variety of objects and the table may be used for a variety of different purposes.

Another aspect is a table that may include a table top that is capable of being moved between a folded position and an unfolded position. Preferably, the table top includes two sections that may be generally aligned in the same plane when the table top is in the unfolded position and may be generally positioned adjacent and parallel to each other when the table top is in the folded position. If desired, the two sections may be connected using hinges or other structures, which may allow the two sections to move between the folded and unfolded positions. The table may also include legs that are movable between an extended position and a collapsed position. Advantageously, if the table includes both a foldable table top and legs that can be selectively moved between use and storage positions, then the table may be stored in a relatively compact area. This may allow, for example, a single person to easily move and transport the table. In addition, this may allow the table to be positioned in a relatively small area, such as the backseat or trunk of an automobile. Further, this may allow one or more tables to be shipped and/or stored in relatively small areas.

Yet another aspect is a table that may include a first table top section, a second table top section and a leg assembly, which may include a first leg, a second leg and a foldable crossbar connected to first and second legs. The crossbar preferably includes a first section connected to the first leg and a second section connected to the second leg, and the first and second crossbar sections may be connected using a hinge or other suitable structures. The leg assembly is preferably pivotally or movably connected to the table top, which may allow the leg assembly to move between a use position and a storage position. In particular, the first and second crossbar sections may be pivotally or movably connected to first and second rails, respectively, and the first and second rails may be connected to the first and second table top sections, respectively. When the leg assembly is in the storage position, the hinge may allow the crossbar sections to fold together with the table top sections because, for example, the hinge may be positioned to fold in the same direction that the table top sections are positioned to fold. When the leg assembly is in the use position, the hinge may be positioned to make the crossbars resist the folding of the table top because, for example, the hinge may be positioned to fold in a different direction than the table top sections.

Still another aspect is a table that may include a first table top section, a second table top section and a leg assembly. The leg assembly may include a first leg and a first section of a crossbar formed from a first piece of bent tubing. The leg assembly may also include a second leg and a second section of a crossbar formed from a second piece of bent tubing. The first and second crossbar sections may be connected using a hinge or other suitable structures. The leg assembly is preferably pivotally or movably connected to the table top, which may allow the leg assembly to move between a use position and a storage position. In particular, the first and second crossbar sections may be pivotally or movably connected to first and second rails, respectively, and the first and second rails may be connected to the first and second table top sections, respectively. When the leg assembly is in the storage position, the hinge may be preferably positioned to allow the crossbar sections to fold together with the table top sections because, for example, the hinge may be positioned to fold in the same direction that the table top sections are positioned to fold. When the leg assembly is in the use position, the hinge may be positioned to make the crossbars resist the folding of the table top because, for example, the hinge may be positioned to fold in a different direction than the table top sections. The leg assembly may also include or be connected to first and second brackets that may pivotally or movably connect the first and second crossbar sections to the first and second rails.

Another aspect is a table that may include a first table top section, a second table top section and a leg assembly, which may include a first leg, a second leg and a foldable crossbar connected to first and second legs. The crossbar preferably includes first and second crossbar sections that may be pivotally or movably connected using a hinge or other suitable structures. The table may also include a clip that may be connected to the first table top section and/or the first crossbar section. The clip may be sized and configured to receive and retain a portion of the second crossbar section when the table is in the folded position. Desirably, the clip may retain the portion of the second crossbar section using a snap, friction and/or interference fit to help secure the table in the folded position.

Yet another aspect is a table that may include a table top, a frame and a leg. The frame may be connected to the table top and the leg may be pivotally or movably connected to the frame to permit the leg to pivot or move between an extended or use position and a collapsed or storage position. The table may also include a brace that may be pivotally or movably connected to the leg and/or the frame. The brace may be any suitable type of brace and the table may include a biasing assembly that is sized and configured to bias the brace into a position in which the brace secures the leg in the extended position. In further detail, the brace may include a first portion pivotally coupled to the frame and a second portion (such as a slot) slidably coupled to a pin, which may be connected to, or form part of, the leg. A portion of the slot may be sized and configured to engage the pin to secure the leg in the extended position, and the biasing assembly may be sized and configured to bias the brace towards a position in which the slot engages the pin.

A further aspect is a table that may include a leg, a brace and a biasing assembly that is sized and configured to bias the brace into a desired position. For example, the biasing assembly may bias the brace so that it secures the leg in an extended or use position. The biasing assembly may include one or more biasing members, such as washers or spacers. In greater detail, the biasing assembly may include first and second biasing members that are sized and configured to move relative to each other. This movement may help bias the brace into a locking position in which the brace secures the leg in the extended position. The table may also include a frame, if desired. The frame, first biasing member, second biasing member and brace may be interconnected using, for example, a fastener. As the leg is moved between a collapsed or storage position and an extended or use position, portions of the first and second biasing members may engage each other to bias the brace towards the locking position. These engaging portions may have, for example, a sloped or angled configuration and that may help bias the brace into the desired position. To help bias the brace, the first biasing member may be generally fixedly connected to the frame, the second biasing member may be generally fixedly connected to the brace, and/or at least a portion of the first and second biasing members may be disposed between the brace and the frame.

Still another further aspect is a table that may include a table top and a frame. The frame may include one or more elongated members or rails, and one or more legs may be connected to the rails. The rails may include curved portions and the legs may be connected to the curved portions using one or more brackets. Desirably, the brackets and/or the curved portions may allow the legs to have a wider stance and/or be disposed closer to an outer perimeter of the table top, which may help provide additional stability for the table. It will be appreciated, however, that the rails do not require curved portions and that the legs may be connected to other portions of the frame using any suitable structures or means. It will also be appreciated that the table does not require the frame and that the legs may be connected to other suitable portions of the table.

Another aspect is a table that may include a first table top section, a second table top section and a leg assembly, which may include a first leg, a second leg and a crossbar connected to first and second legs. The crossbar preferably includes first and second sections that may be pivotally or movably interconnected using, for example, a hinge. The table may also include a spacer and/or reinforcement that is sized and configured to strengthen and/or reinforce the hinge. In further detail, the hinge may include a first hinge member that may include one or more flanges and a second hinge member that may include one or more flanges. The flanges of the second hinge member may be connected to the flanges of the first hinge member. A spacer and/or reinforcement structure may be at least partially disposed between the flanges of the first hinge member and/or the second hinge member, which may help strengthen and/or reinforce the hinge. This may be particularly helpful when the hinge is sized and configured to help the crossbars resist the folding of the table top when the leg assembly is in the extended or use position.

Yet another aspect is a table that may include a table top and one or more components that are sized and configured to be connected to the table top, such as a frame, brackets or the like. The table top and the components may be constructed from materials with different characteristics. For example, the table top and the components may expand and/or contract in different fashions in response to changes in temperature. In particular, the table top may be constructed from plastic, which may expand or contract in response to particular temperatures, and the components may be constructed from metal, which may expand or contract more or less in response to those same temperatures. Significantly, the components may be sized and configured to accommodate these differences in expansion and contraction. In further detail, the components may include at least one opening that is sized and configured to receive a fastener to connect these components to the table top. Desirably, the openings may be sized and configured to accommodate the differences in expansion and contraction. For example, an opening may be a slot and, as the table top expands and/or contracts, the fastener may move within the slot, which may help prevent such expansion and/or contraction from disfiguring, warping and/or otherwise damaging the table top. Also, for example, the opening may have an area that is at least about one and one-half (1.5) times, two (2) times, three (3) times or more the cross section of the inserted portion of the fastener, which may permit the fastener to have greater movement within the opening as the table top expands and/or contracts. This may also help prevent such expansion and/or contraction from disfiguring, warping and/or otherwise damaging the table top.

A further aspect is a table that may comprise a table top including a first table top section and a second table top section. The first table top section and the second table top section may be movable between a folded position and an unfolded position. The first table top section and the second table top section may be generally aligned in the same plane when in the unfolded position, and the first table top section and the second table top section may be generally disposed adjacent and parallel to each other when in the folded position. The table may also include a leg assembly that is movable between a use position and a storage position relative to the table top. The leg assembly may comprise a first leg, a second leg and a foldable crossbar comprising a first crossbar section connected to the first leg and a second crossbar section connected to the second leg. A hinge may connect the first crossbar section and the second crossbar section. The hinge is preferably positioned in a first position that facilitates folding of the table top when the leg assembly is in the storage position, and the hinge is preferably positioned in a second position that resists folding of the table top when the leg assembly is in the extended position. The hinge may be configured to move from the first position to the second position when the leg assembly is moved from the storage position to the use position. The hinge may also be configured to move from the second position to the first position when the leg assembly is moved from the use position to the storage position. The table may further comprise a frame connected to the table top; a brace movably connected to the frame and the first leg; and a biasing assembly at least partially disposed between the brace and the frame. The biasing assembly may be sized and configured bias the brace into a locking position, the biasing assembly may comprise a first biasing member including a sloped engaging surface; and a second biasing member including a sloped engaging surface that is sized and configured to engage the sloped engaging surface of the first biasing member.

A still further aspect is a table that may comprise a foldable table top including a first section and a second section. The first and second sections may be movable between a folded position and an unfolded position. The first and second sections may be generally aligned in the same plane when in the unfolded position, and the first and second sections may be generally disposed adjacent and parallel to each other when in the folded position. The table may also comprise a hinge interconnecting the first and second sections of the table top; and a leg movable between a use position and a storage position relative to the table top. If desired, the hinge may facilitate folding of the table top when the leg is in the storage position, and the hinge may resist folding of the table top when the leg is in the extended position. When the hinge is positioned in a first position, that may facilitate folding of the table top when the leg assembly is in the storage position; and when the hinge is positioned in a second position, that may resist folding of the table top when the leg assembly is in the extended position. The table may also comprise a first crossbar section connected to the first table top section; a second crossbar section connected to the second table top section; and the hinge may be connected to the first and second crossbar sections to interconnect the first and second table top sections.

Another further aspect is a table that may comprise a table top constructed from plastic; at least one leg that is sized and configured to support the table top relative to a support surface; a first metal rail including an elongated opening; a first fastener inserted through the elongated opening of the first metal rail and connecting the first metal rail to the table top, the first fastener being configured to move within the elongated opening of the first metal rail when the table top expands and/or contracts in response to changes in temperature; a second metal rail including an elongated opening; and a second fastener inserted through the elongated opening of the second metal rail and connecting the second metal rail to the table top, the second fastener being configured to move within the elongated opening of the second metal rail when the table top expands and/or contracts in response to changes in temperature. If desired, the first and second fasteners may be oriented in generally the same direction. In addition, the elongated opening of the first metal rail may have a length that is at least about 1.5 times a diameter of the inserted portion of the first fastener. The elongated opening of the first metal rail may also have a length that is at least about two times a diameter of the inserted portion of the first fastener. The elongated opening of the first metal rail may further have a length that is at least about three times a diameter of the inserted portion of the first fastener.

Still yet another further aspect is a table that may comprise a table top constructed from plastic; at least one leg connected to the table top; a first metal rail; a first bracket connected to the first metal rail; an opening in the first bracket; a first fastener inserted through the opening in the first bracket and connecting the first bracket to the table top, the first fastener being sized and configured move within the opening in the first bracket when the table top expands and/or contracts in response to changes in temperature, the opening in the first bracket having an area that is at least about 1.5 times the cross section of the inserted portion of the first fastener; a second bracket connected to the first metal rail; an opening in the second bracket; and a second fastener inserted through the opening in the second bracket and connecting the second bracket to the table top, the second fastener being sized and configured move within the opening in the second bracket when the table top expands and/or contracts in response to changes in temperature, the opening in the second bracket having an area that is at least about 1.5 times the cross section of the inserted portion of the second fastener. If desired, the first and second fasteners may be oriented in generally the same direction.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards tables. The principles of the present invention, however, are not limited to tables. It will be understood that, in light of the present disclosure, the table disclosed herein can be successfully used in connection with other types of furniture and/or structures.

Additionally, to assist in the description of the table, words such as top, bottom, front, rear, right and left may be used to describe the accompanying figures, which are not necessarily drawn to scale. It will be appreciated, however, that the table can be located in a variety of desired positions and/or orientations. A detailed description of the table now follows.

Figure 1:
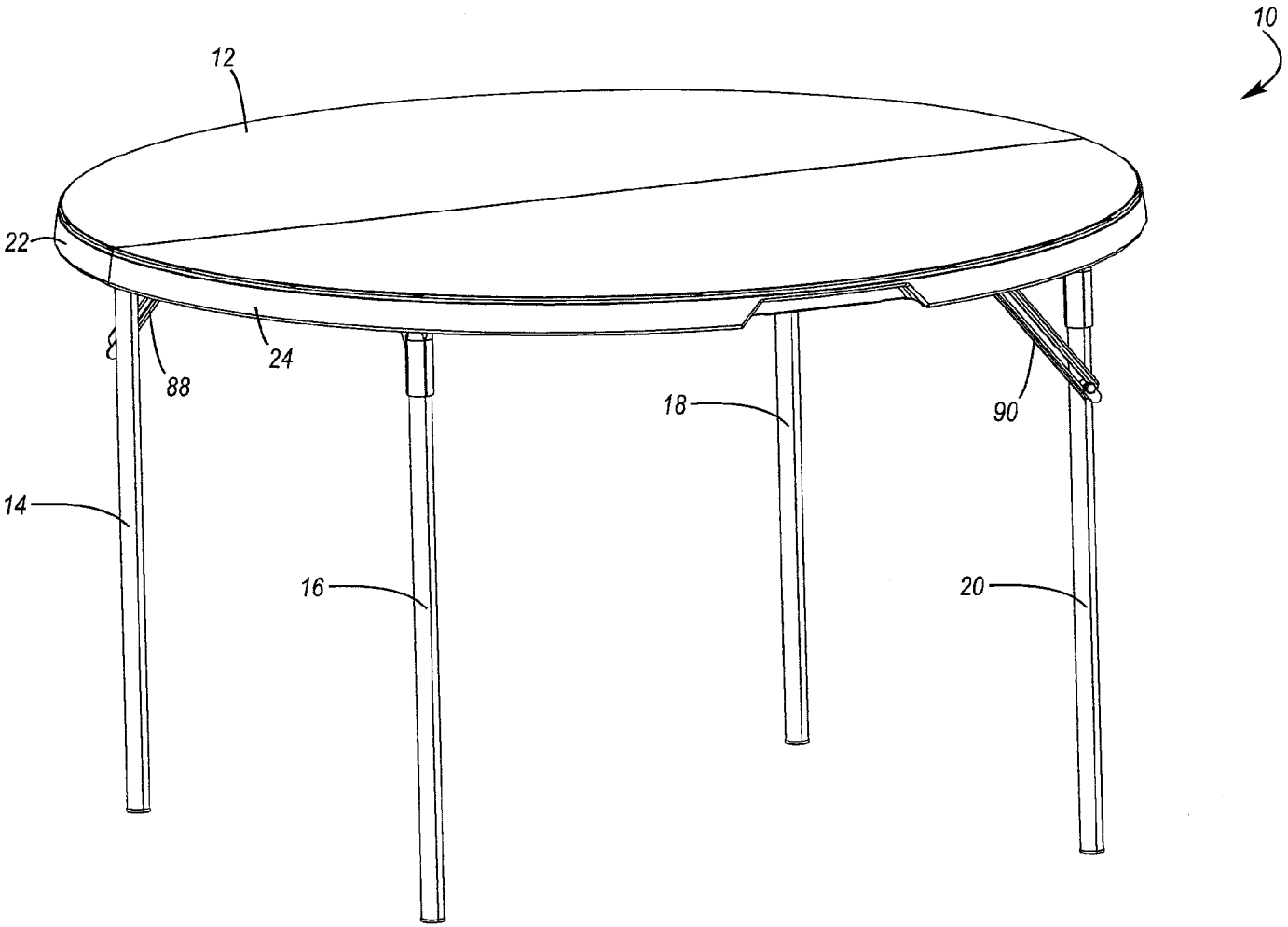
FIG. 1 is an upper perspective view of an exemplary table, illustrating a table top in an unfolded position and legs in an extended or use position.
Figure 2:
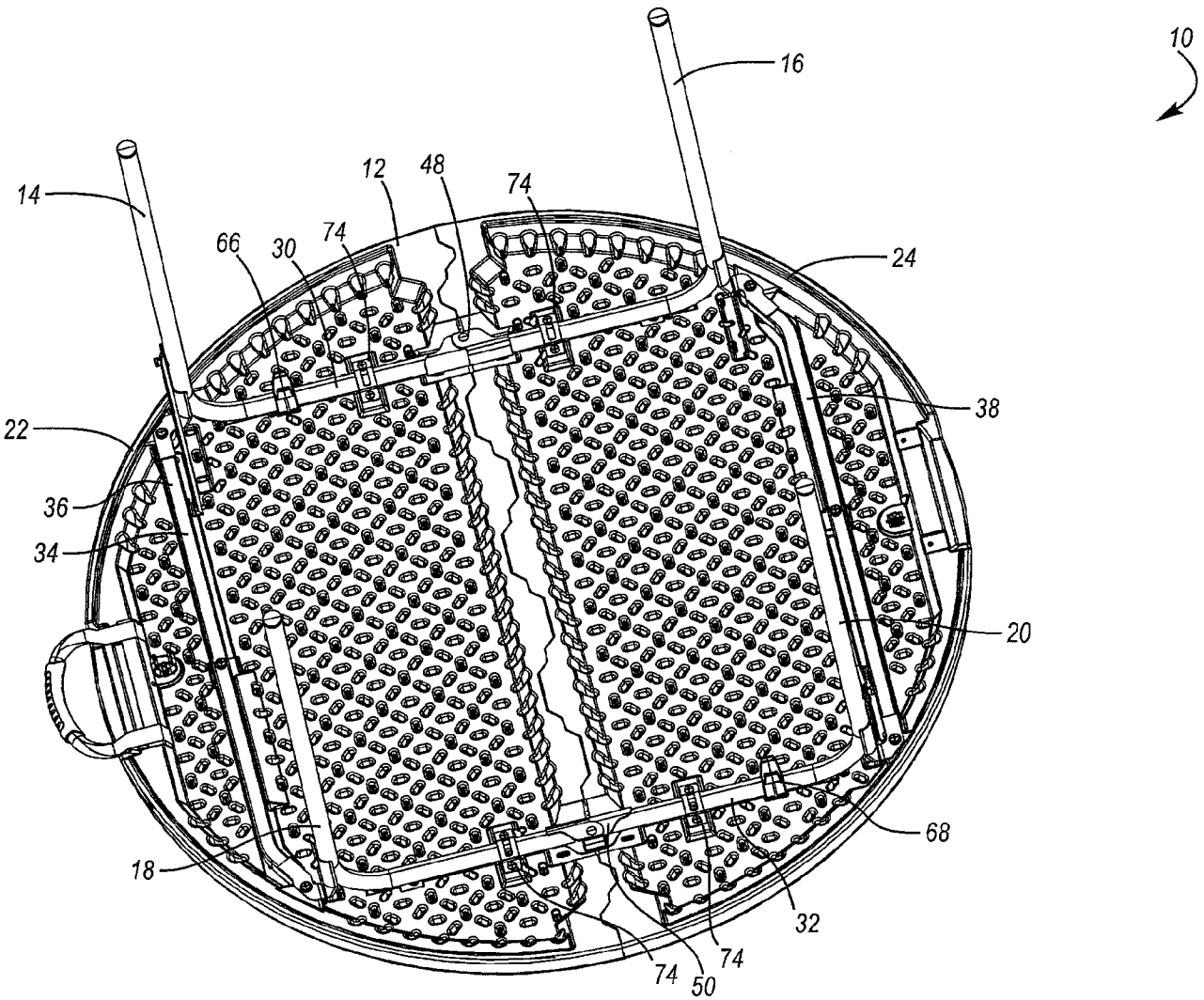
FIG. 2 is a lower perspective view of the table shown in FIG. 1.
Figure 3:
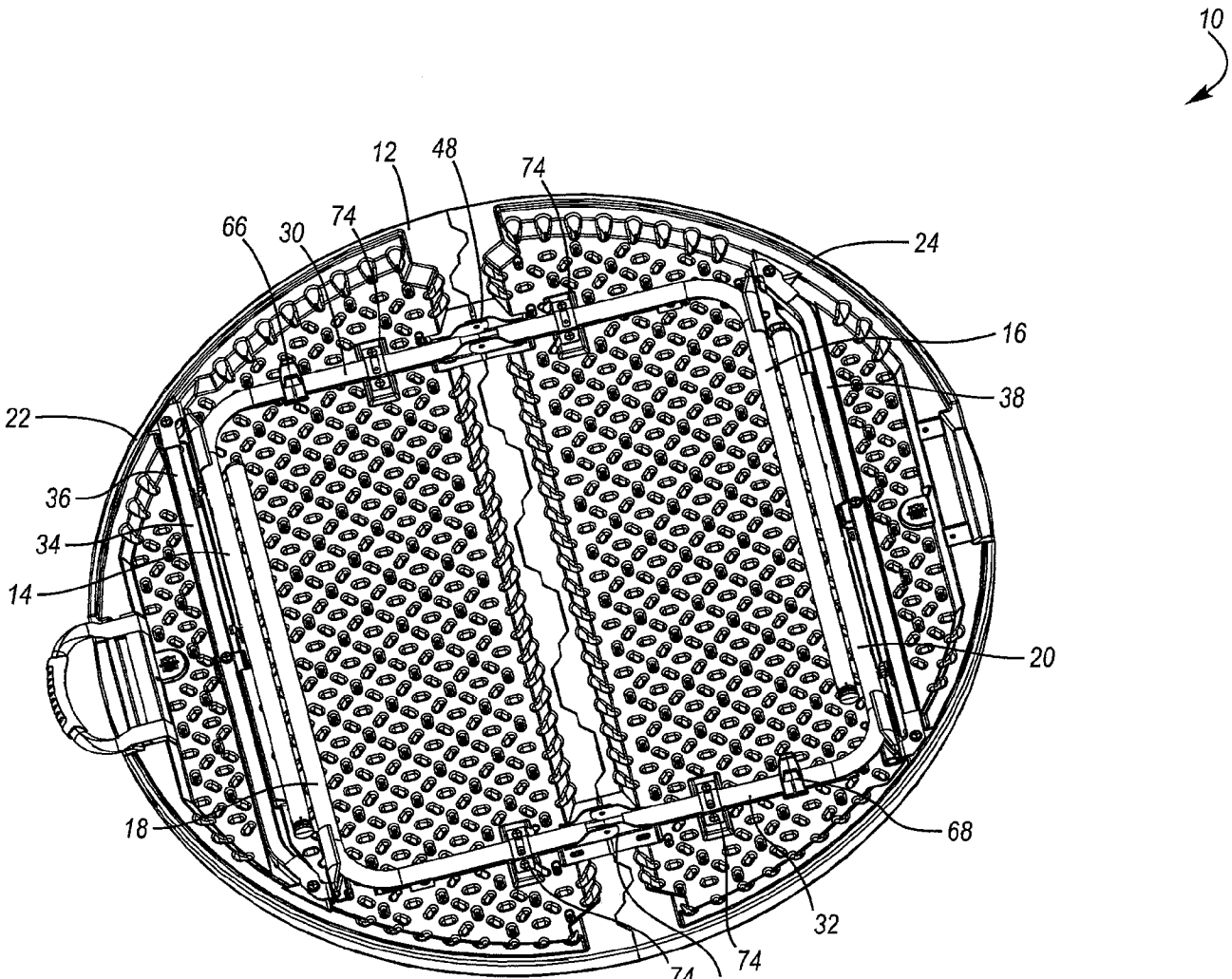
FIG. 3 is a lower perspective view of the table shown in FIG. 1, illustrating the legs in a collapsed or storage position.

As shown in FIG. 1, a table 10 may include a table top 12 and one or more legs or support pedestals 14, 16, 18, 20 that may be sized and configured to support the table top in a use or support position. The legs 14, 16, 18, 20 are preferably movable between an extended or use position, as shown in FIG. 2, and a collapsed or storage position, as shown in FIG. 3. Advantageously, when the legs 14, 16, 18, 20 are in the use position, the table may be used to support a wide variety of objects and the table may be used for a variety of different purposes.

If desired, the legs 14, 16, 18, 20 may have adjustable lengths, which may allow the height of the table top 12 to be adjusted among a plurality of different heights. In addition, the legs 14, 16, 18, 20 may be disposed at an oblique angle relative to the table top 12, which may help provide a wider base. It will be appreciated, however, that the legs 14, 16, 18, 20 need not have adjustable lengths; may be disposed perpendicularly, obliquely and/or in any suitable position relative to the table top 12; and may have a variety of suitable shapes, sizes, configurations and arrangements depending, for example, upon the intended use of the table 10.

Figure 4:
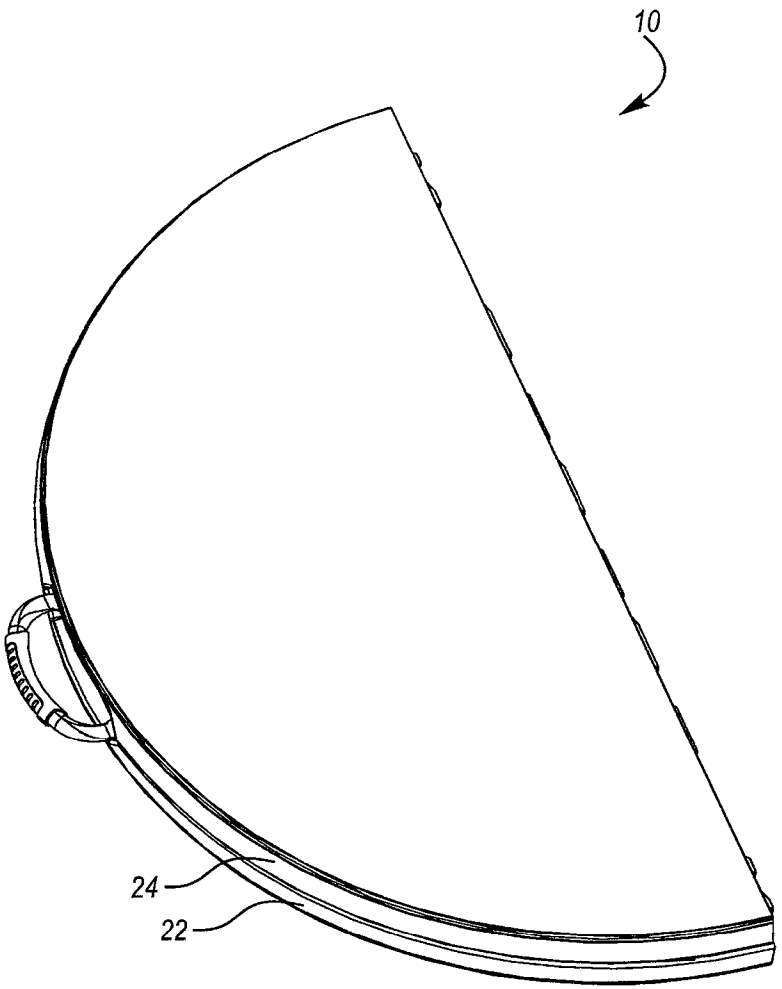
FIG. 4 is an upper perspective view of the table shown in FIG. 1, illustrating the table top in a folded position.

As shown in FIGS. 1 and 4, the table top 12 may be sized and configured to be moved between a folded position and an unfolded position. In further detail, as shown in FIG. 1, the table top 12 may include table top sections 22, 24, which may be generally aligned in the same plane when the table top is in the unfolded position, as shown in FIG. 1, may be generally positioned adjacent and parallel to each other when the table top is in the folded position, as shown in FIG. 4. If desired, the table top sections 22, 24 may be pivotally or otherwise movably interconnected using, for example, one or more hinges, frames, crossbars and/or other structures, which may allow the two sections to move between the folded and unfolded positions.

Advantageously, with a foldable table top 12 and legs 14, 16, 18, 20 that can be selectively moved between use and storage positions, the table 10 may be stored in a relatively compact area. This may allow, for example, a single person to easily move and transport the table 10. In addition, this may allow the table 10 to be positioned in a relatively small area, such as the backseat or trunk of an automobile. Further, this may allow one or more tables 10 to be shipped and/or stored in relatively small areas.

Figure 5:
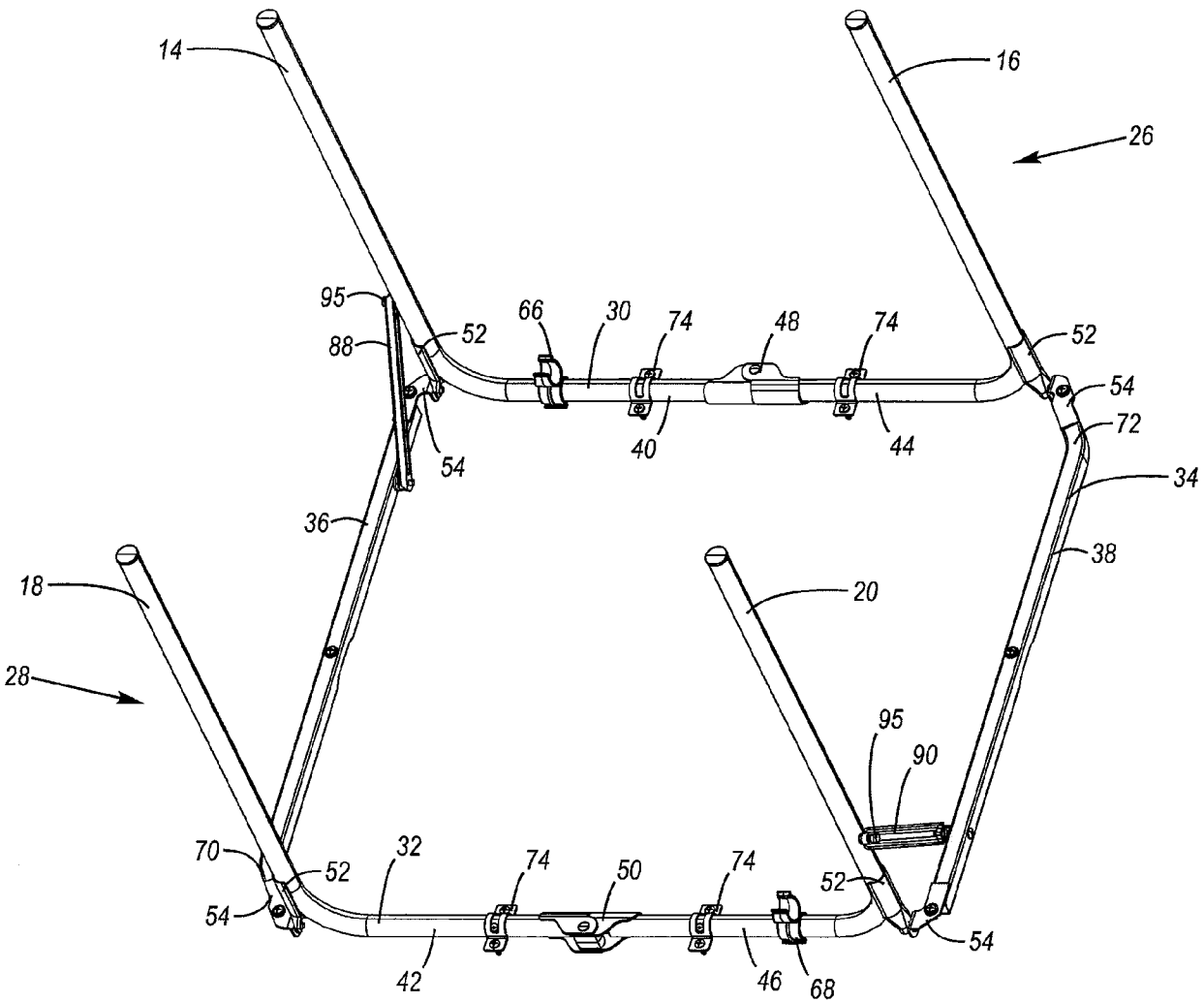
FIG. 5 is a lower perspective view of a portion of the table shown in FIG. 1, illustrating the frame.

As shown in FIG. 5, the table 10 may include one or more leg assemblies 26, 28 that may include a pair of legs and a crossbar interconnecting the legs. For example, the leg assembly 26 may include the legs 14, 16 and a crossbar 30 connected to the legs 14, 16, and the leg assembly 28 may include the legs 18, 20 and a crossbar 32 connected to the legs 18, 20. Desirably, with a crossbar interconnecting a pair of legs, the pair legs may be moved collectively between the storage and use positions. The legs 14, 16, 18, 20, however, need not be interconnected may be sized and configured to be independently moved between the storage and use positions. In addition, the independently movable legs may be sized and configured to automatically lock in the extended position using, for example, one or more locking hinges. It will be appreciated, however, that the table 10 does not require independently movable legs or locking hinges.

As shown in FIGS. 2-3 and 5, the table 10 may also include a frame 34 that may be connected to the leg assemblies 26, 28 and/or the table top 12. In particular, the frame 34 may include rails 36, 38, which may be connected to and help support the table top sections 22, 24. The leg assemblies 26, 28 may be pivotally or otherwise movably connected to the rails 36, 38 of the frame 34, which may help the leg assemblies move between an extended or use position and a collapsed or storage position relative to the table top 12.

As shown in FIG. 5, the crossbars 30, 32 of the leg assemblies 26, 28 may include a first section 40, 42 connected to the legs 14, 18 and a second section 44, 46 connected to the legs 16, 20. If desired, a leg and a crossbar section may be formed from a single piece of bent tubing. For example, the leg 14 and the crossbar section 40, the leg 16 and the crossbar section 44, the leg 18 and the crossbar section 42 and the leg 20 and the crossbar section 46 may each be formed from a piece of bent tubing.

The crossbar sections 40, 42 may be pivotally or otherwise movably connected to the crossbar sections 44, 46, respectively, using a hinge 48, 50 and/or other suitable structures. The leg assemblies 26, 28 may also include or be connected to one or more brackets 52, 54 that may pivotally or movably connect the crossbar sections 40, 42, 44, 46 to the rails 36, 38. It will be appreciated that the leg assemblies 14, 16 may consist of a single leg or may include a variety of other suitable components depending, for example, upon the particular configuration of the leg assemblies.

Desirably, because the crossbars 30, 32 may include a plurality of movably interconnected sections, the crossbars 30, 32 may be sized and configured to move between a folded position and an unfolded position. This may help the table top 12 move between a folded position and an unfolded position. For example, when the leg assemblies 26, 28 are in the storage position as shown in FIG. 3, the hinges 48, 50 may be positioned to allow the crossbar sections 40, 44 and the crossbar sections 42, 46 to fold together with the table top sections 22, 24 because, for example, the hinges are positioned to fold in the same direction that the table top sections are positioned to fold.

In contrast, when the leg assemblies 26, 28 are in the use position, the hinges 48, 50 may be positioned to make the crossbars 30, 32 resist the folding of the table top 12 because, for example, the hinges are positioned to fold in a different direction than the table top sections 22, 24. In particular, when the leg assemblies 26, 28 are in the use position as shown in FIG. 2, the hinges 48, 50 may be positioned to fold in a direction that is generally perpendicular to the direction in which the table top sections 22, 24 are configured to fold. This may advantageously allow the crossbars 30, 32 to help prevent the table top 12 from unintentionally folding, for example, when carrying or moving the table 10. Moreover, if the leg assemblies 26, 28 are connected to the frame 34, this may advantageously allow the crossbars 30, 32 and/or the hinges 48, 50 to cooperate with the frame to help strengthen and/or reinforce the table top 12.

Thus, when storage of the table 10 is desired, the leg assemblies 26, 28 may be moved from the use position to the storage position. As the leg assemblies 26, 28 move from the use position to the storage position, the crossbars 30, 32 and/or the hinges 48, 50 may rotate, pivot or otherwise move from a first position in which the hinges are positioned to fold in a different direction than the table top sections 22, 24 to a second position in which the hinges are positioned to fold in the same direction that the table top sections 22, 24 are positioned to fold. The table top sections 22, 24 may then be folded together and the table 10 may be stored in a relatively small area. When use of the table 10 is desired, the table top sections 22, 24 may be unfolded and then leg assemblies 26, 28 may be moved from the storage position to the use position. As the leg assemblies 26, 28 move from the storage position to the use position, the crossbars 30, 32 and/or the hinges 48, 50 may rotate, pivot or otherwise move from the second position back to the first position.

Figure 6:
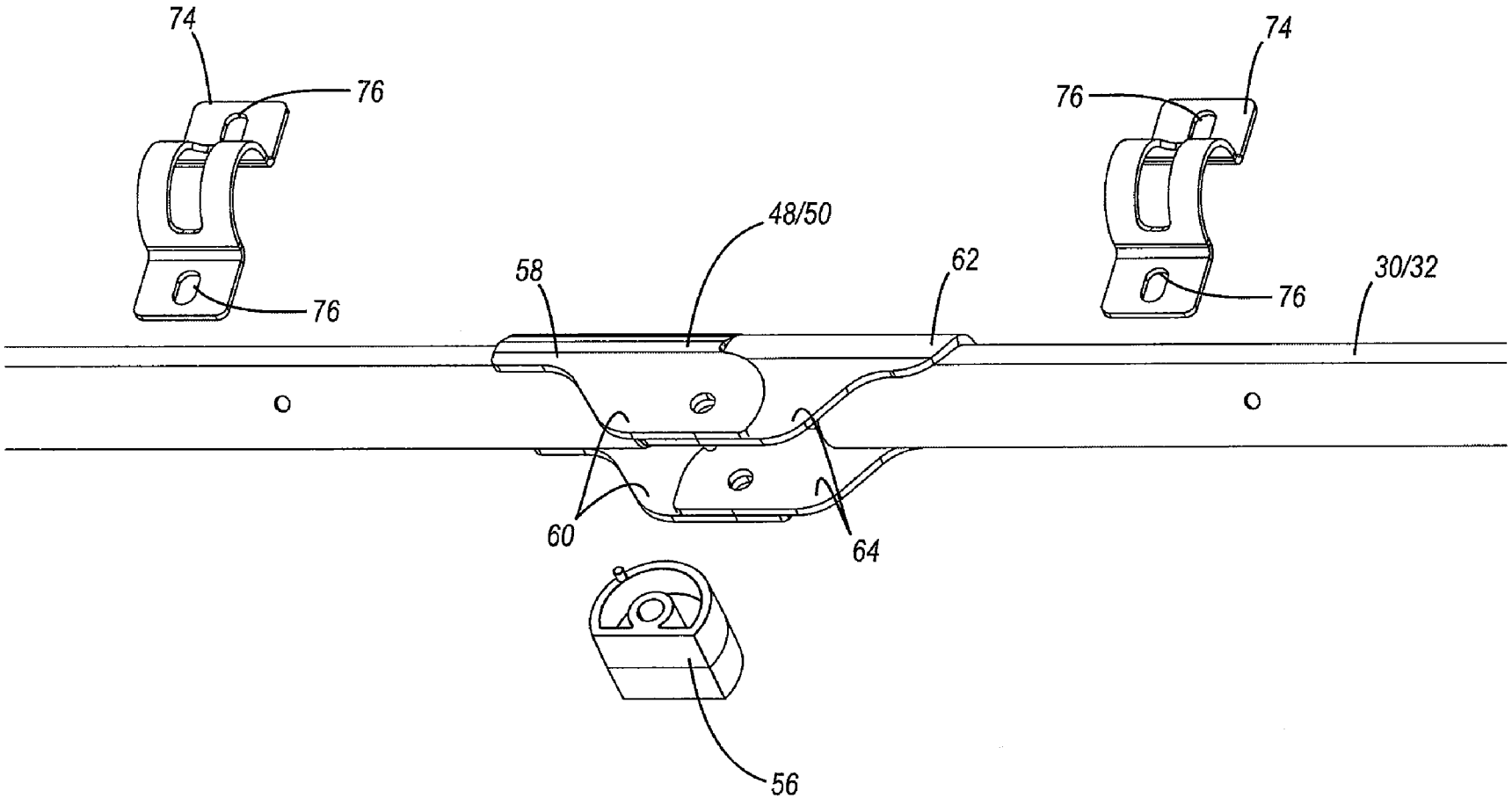
FIG. 6 is a partially exploded view of a portion of the table shown in FIG. 5.

As shown in FIG. 6, a spacer and/or reinforcement 56 may be used to strengthen and/or reinforce a hinge 48, 50. In further detail, the hinge 48, 50 may include a first hinge member 58 that may include one or more flanges 60 and a second hinge member 62 that may include one or more flanges 64 pivotally or otherwise movably connected to the flanges 60. The spacer and/or reinforcement 56 may be at least partially contact, abut and/or be disposed between the flanges 60 and/or the flanges 64. This may help strengthen and/or reinforce the hinge 48, 50, which may be particularly advantageous when the hinge 48, 50 is positioned to resist the folding of the table top 12.

As shown in FIGS. 2-3 and 5, the table 10 may include one or more clips 66, 68. The clips 66, 68 may be respectively connected to the table top sections 22, 24 and/or the crossbar sections 40, 46. For example, the clips 66, 68 may include a base portion that is sized and configured to be connected to the table top sections 22, 24 and/or receive and/or retain a portion of the crossbar sections 40, 46. The clips 66, 68 may also include a receiving portion that is sized and configured to receive and/or retain a portion of the crossbar sections 44, 42, respectively, when the table 10, table top 12 and crossbars 30, 32 are in the folded position. Desirably, the clips 66, 68 may retain the portions of the crossbar sections 44, 42 using a snap fit, a friction fit and/or an interference fit to help secure the table 10, table top 12 and crossbars 30, 32 in the folded position and prevent the table, table top and crossbars from unintentionally unfolding.

As shown in FIG. 5, the rails 36, 38 may include one or more curved, angled and/or offset portions 70, 72 and the leg assemblies 26, 28 may be connected to the curved, angled and/or offset portions using one or more of the brackets 52, 54. Desirably, the brackets 52, 54 and/or the curved, angled and/or offset portions 70, 72 may allow the legs 14, 16, 18, 20 to have a wider stance and/or be disposed closer to an outer perimeter of the table top 12, which may help provide additional stability for the table 10. It will be appreciated, however, that the rails 36, 38 do not require curved, angled and/or offset portions and that the leg assemblies 26, 28 may be connected to other portions of the frame 34 using any suitable means. It will also be appreciated that the table 10 does not require the frame 34 and that the leg assemblies 26, 28 may be connected to other suitable portions of the table.

Figure 7:
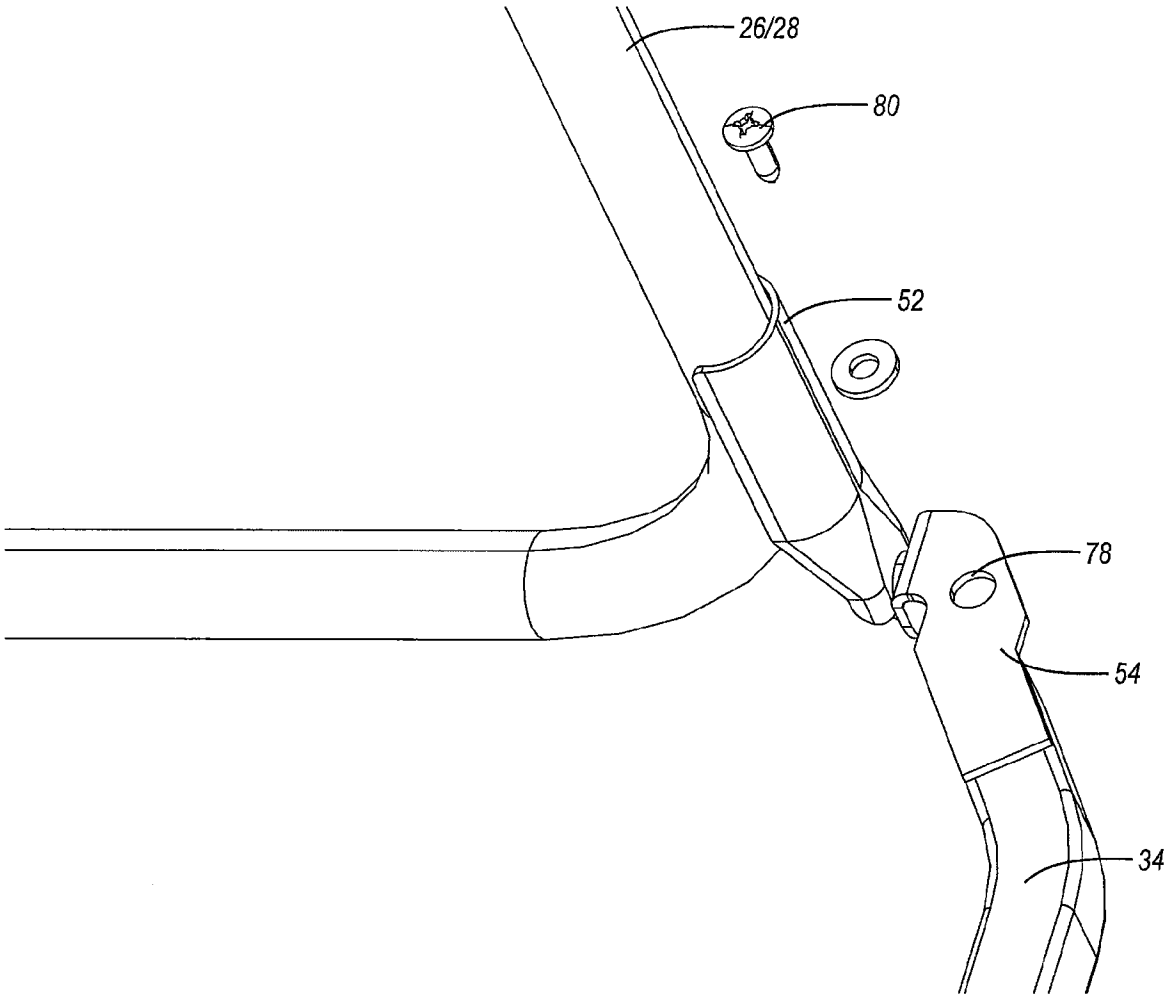
FIG. 7 is a partially exploded view of another portion of the table shown in FIG. 5.
Figure 8:
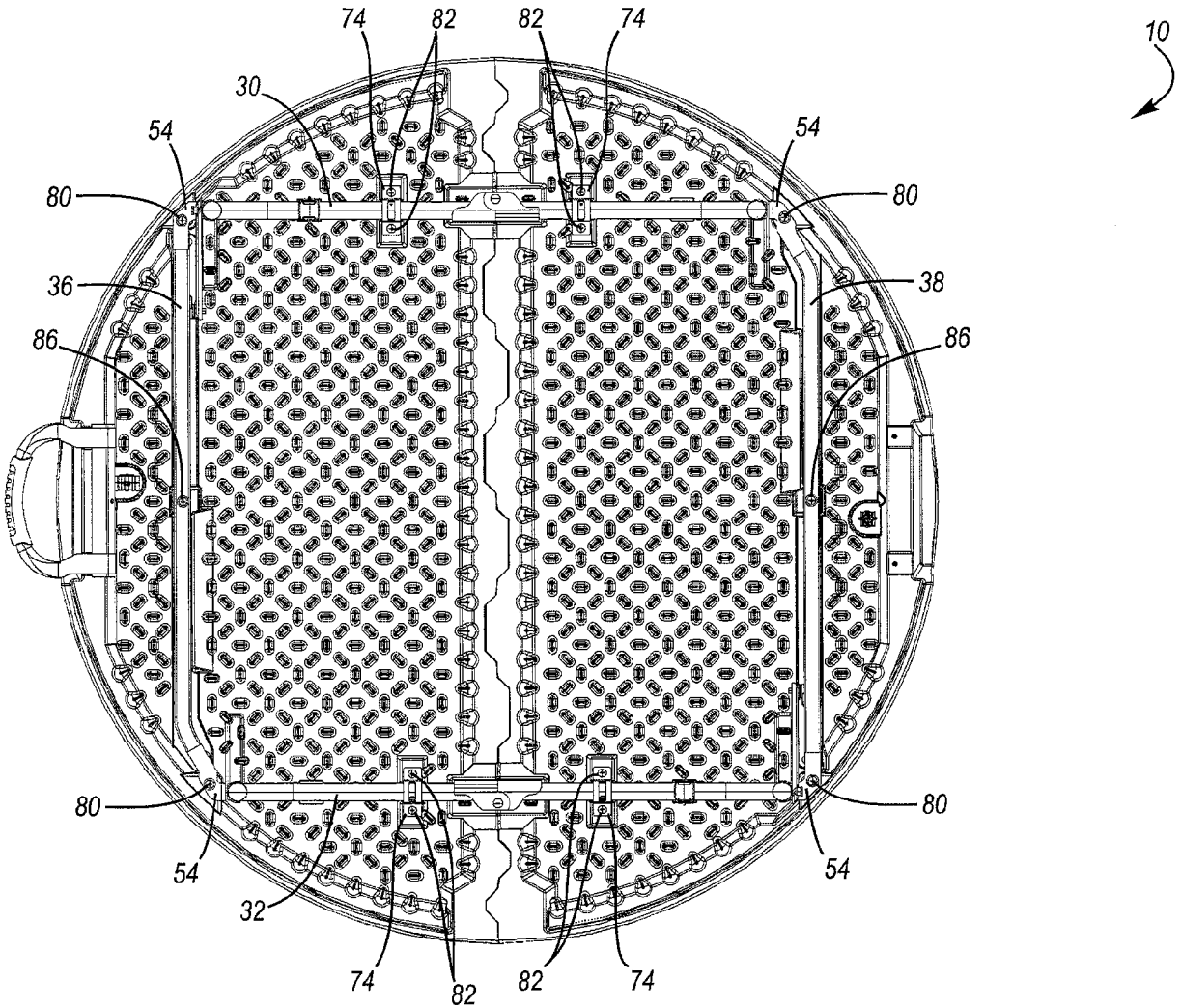
FIG. 8 is a bottom view of the table shown in FIG. 1.
Figure 9:
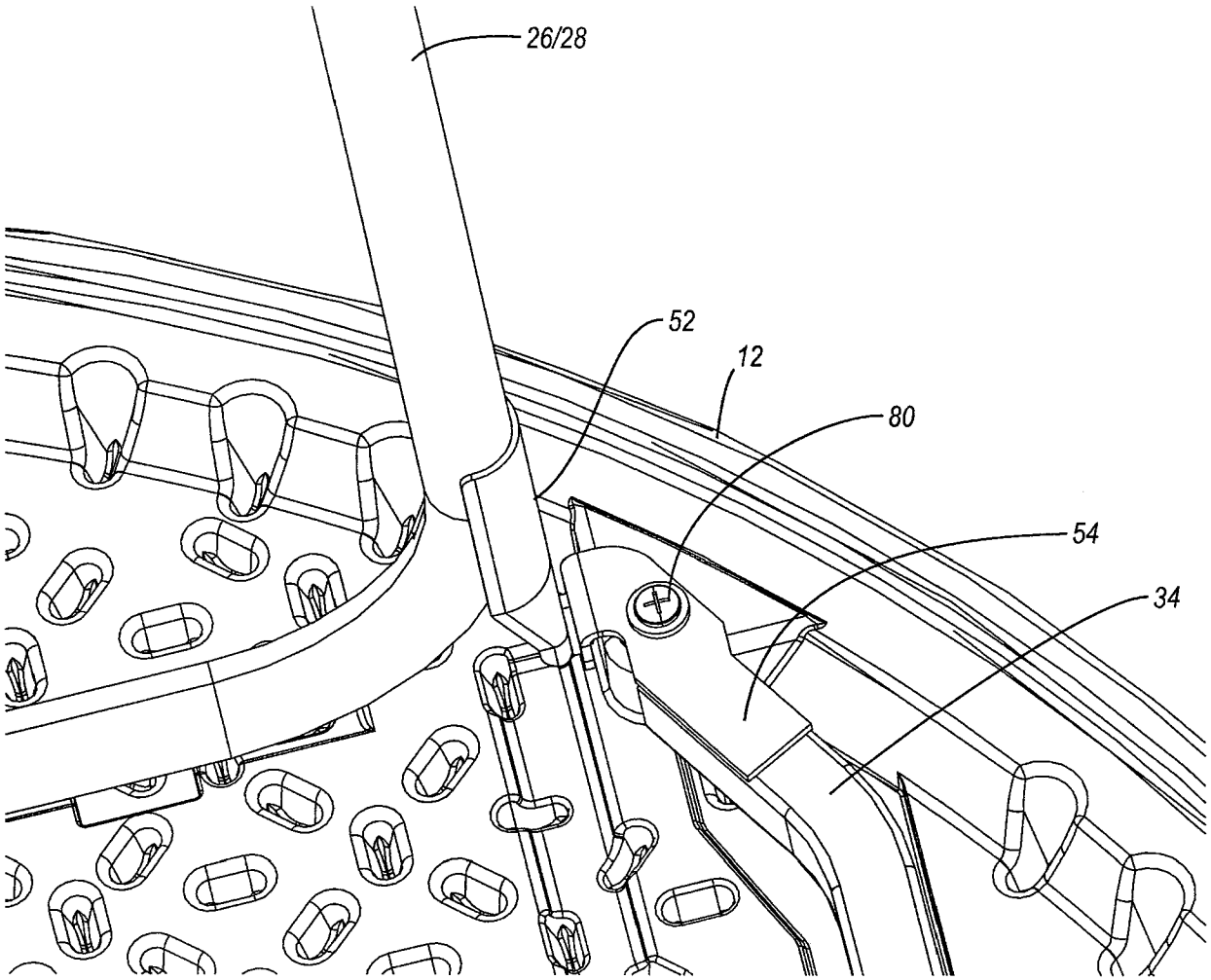
FIG. 9 is an enlarged, lower perspective view of a portion of the table shown in FIG. 1.
Figure 10:
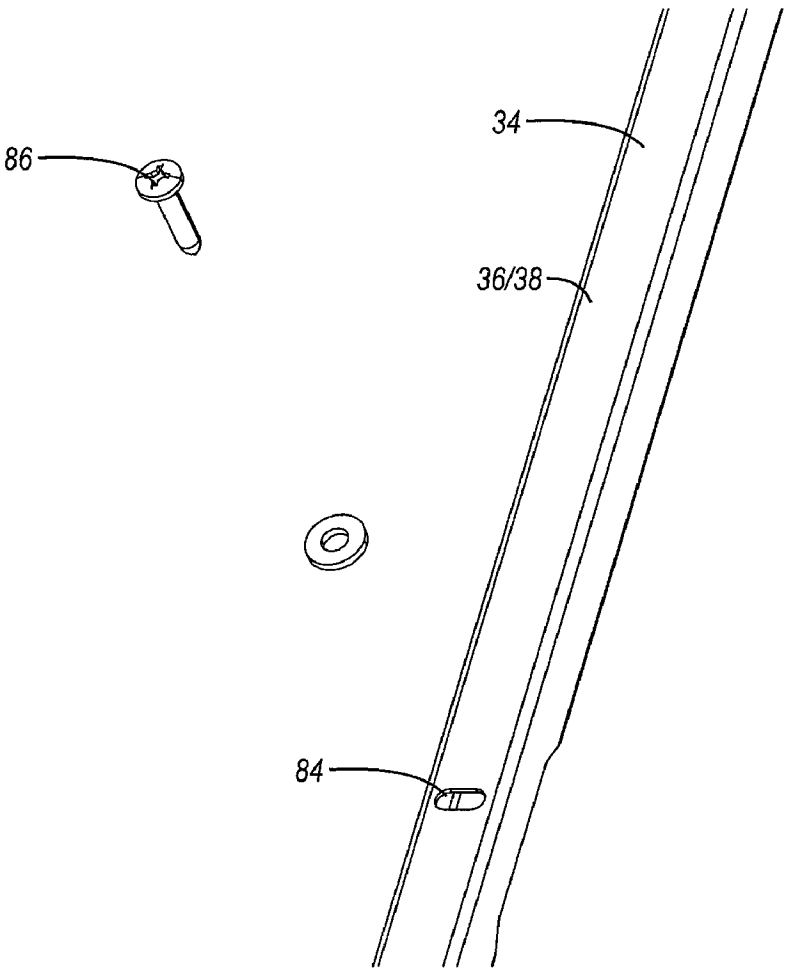
FIG. 10 is an exploded view of a portion of the table shown in FIG. 1.

As shown in FIGS. 2-3 and 5, the table 10 may include one or more brackets and/or fasteners that may be used to help connect the leg assemblies 26, 28 and/or the frame 34 to the table top. For example, the table 10 may include one or more brackets 74 that may rotatably or otherwise movably connect the crossbars 30, 32 to the table top 12. Also, the brackets 54 (which, as discussed above, may help interconnect the leg assemblies 26, 28 and the frame 34) may connect the leg assemblies 28, 30 and the frame 34 to the table top 12. The brackets 54, 74 may include openings 76, 78 shown in FIGS. 6-7 sized and configured to receive a fastener to connect the brackets to the table top 12. The openings 76, 78 may, for instance, receive fasteners 80, 82 shown in FIGS. 8-9. As shown in FIG. 10, the rails 36, 38 may include openings 84 sized and configured to receive a fastener 86 as shown in FIG. 8.

In some instances, the table 12 and one or more components sized and configured to be connected to the table top (such as, the leg assemblies 26, 28, the frame 34, the brackets 54, 74, and/or other components) may be constructed from materials with different characteristics. For example, the table top 12 and these components may expand and/or contract in different fashions in response to changes in temperature. In particular, the table top 12 may be constructed from plastic, which may expand or contract in response to particular temperatures, and these components may be constructed from metal, which may expand or contract more or less in response to those same temperatures. Significantly, some or all of these components may be sized and configured to accommodate these differences in expansion and contraction.

In further detail, some or all of these components may include at least one opening that is sized and configured to receive a fastener to connect these components to the table top 12. Desirably, the openings may be sized and configured to accommodate the differences in expansion and contraction. For example, the openings 76, 84 in the brackets 74 and rails 36, 38 may be slots and, as the table top 12 expands and/or contracts, the fasteners may move within the slots, which may help prevent such expansion and/or contraction from disfiguring, warping and/or otherwise damaging the table top. The slots 76, 84 may have a length that is at least about one and one-half (1.5) times, twice (2) times, three (3) times or more a diameter of the inserted portion of the fastener 82, 86. If desired, the slots 76 may have an elongated shape that extends in a first direction and the slots 84 may have an elongated shape that extends in a second direction that may be generally perpendicular to the first direction. This may advantageously help maintain a generally consistent, uniform and/or balanced expansion and/or contraction of the table top 12, which may help further avoid disfiguring, warping and/or otherwise damaging the table top.

In addition, the openings 78 in the brackets 54 may have an area that is at least about one and one-half (1.5) times, twice (2) times, three (3) times or more the cross section of the inserted portion of the fastener 80, which may permit the fasteners to have greater movement within the openings as the table top 12 expands and/or contracts. This may also help prevent such expansion and/or contraction from disfiguring, warping and/or otherwise damaging the table top 12.

Moreover, some or all of the fasteners 80, 82, 86 may be oriented in the generally the same direction, for instance, facing a lower portion of the table top. Desirably, if some or all of the fasteners 80, 82, 86 are oriented in the generally the same direction, then the risk of the fasteners disfiguring, warping and/or otherwise damaging the table top 12 from its expansion and/or contraction may be reduced. The fasteners 80, 82, 86, however, need not be oriented in generally the same direction and may have other suitable positions and/or orientations.

Figure 11:
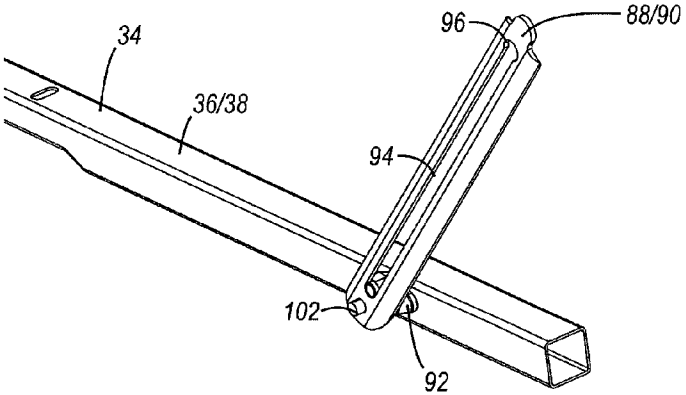
FIG. 11 is a perspective view of a portion of the table shown in FIG. 1, illustrating an exemplary brace for a leg and a biasing assembly.

As shown in FIG. 5, the table 10 may include one or more braces that may be connected to a leg 14, 16, 18, 20 and/or the frame 34. For example, a brace 88 may be pivotally or otherwise movably connected to the rail 36 and the leg 14, and a brace 90 may be pivotally or otherwise movably connected to the rail 38 and the leg 20. The braces 88, 90 may be any suitable type of brace and, as shown in FIG. 11, the table 10 may include a biasing assembly 92 that is sized and configured to bias the braces 88, 90 into a position in which the braces secure the legs 14, 20 in the extended position.

In further detail, a brace 88, 90 may include a first portion pivotally coupled to the rails 36, 38 and a second portion (such as a slot 94) slidably coupled to a pin 95, which may be connected to, or form part of, the leg 14, 20. A portion 96 of the slot 94 may be sized and configured to engage the pin 95 to secure the leg 14, 20 in the extended position, and the biasing assembly 92 may be sized and configured to bias the brace 88, 90 towards a position in which the slot engages the pin.

Figure 14:
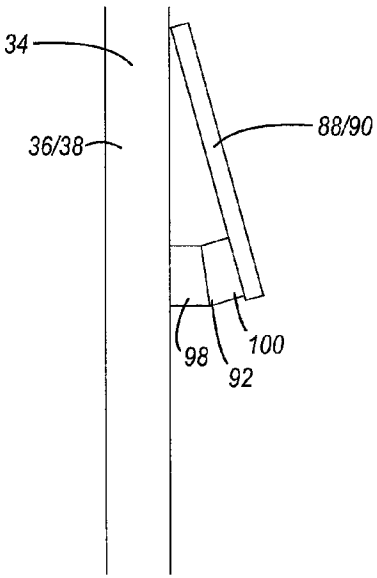
FIG. 14 is another diagram of a portion of the table shown in FIG. 11, illustrating an exemplary position of the brace and the biasing assembly when the leg is in an extended position.
Figure 13:
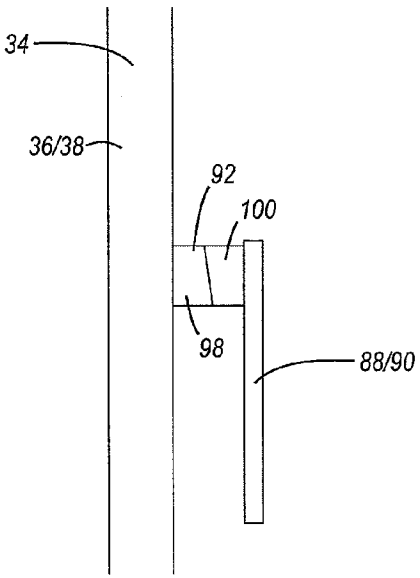
FIG. 13 is a diagram of the portion of the table shown in FIG. 1 1, illustrating an exemplary position of the brace and the biasing assembly when the leg is in a collapsed position.
Figure 12:
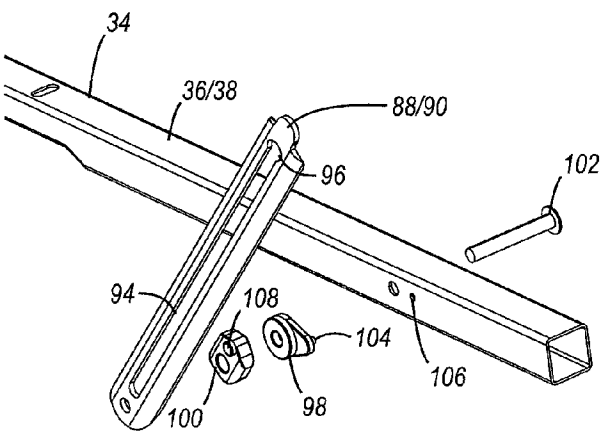
FIG. 12 is an exploded view of the portion of the table shown in FIG. 11.

As shown in FIGS. 12-14, the biasing assembly 92 may include one or more biasing members 98, 100, such as washers or spacers, which may be sized and configured to move relative to each other. This movement may help bias the brace 88, 90 into a locking position in which the brace secures the leg 14, 20 in the extended position. For example, as the leg 14, 20 is moved from the storage position to the extended position, portions of the biasing members 98, 100 may engage each other to bias the brace 88, 90 towards the locking position. These engaging portions may have, for instance as shown in FIGS. 13-14, a sloped or angled configuration that may help bias the brace 88, 90 into the locking position.

To help the biasing members 98, 100 bias the brace 88, 90, at least a portion of the biasing members may be disposed between the brace and the frame 34. In addition, to help the biasing members 98, 100 bias the brace 88, 90, the biasing member 98 may be generally fixedly connected to the frame, and the biasing member 100 may be generally fixedly connected to the brace.

In greater detail, as shown in FIGS. 11-12, the frame 34, the biasing members 98, 100 and the brace 88, 90 may be interconnected using, for example, a fastener 102. The biasing member 98 may include a projection 104 that may be inserted into an opening 106 formed in the frame 34, which may help generally fixedly connect the biasing member to the frame. The biasing member 100 may include a projection 108 that may be inserted into the slot 94, which may help generally fixedly connect the biasing member to the brace 88, 90. With the fastener 102 interconnecting the frame 34, the biasing members 98, 100 and the brace 88, 90, the brace and the biasing member 100 may pivot about the fastener, which may cause the sloped or angled engaging portions of the biasing members to bias the brace 88, 90 into the locking position. It will be appreciated, however, that the biasing members may be connected to other portions of the table and may be disposed in other suitable locations. It will also be appreciated that the engaging portions of the biasing members may have other suitable shapes, sizes, configurations and arrangements, if desired.

In some embodiments, a hinge (such as the hinges 48, 50) may interconnect the table top sections 22, 24 and may be movable between a first position in which the table top 12 is folded for storage and a second position in which the table top is unfolded for use. While the table top 12 is unfolded for use and the hinge is in its second position, a locking member may slide or otherwise move between an unlocked position and a locked position. When in the locked position, the locking member may restrict the movement of the hinge away from the hinge's second position, which may prevent the table top sections 22, 24 from unintentionally folding. For example, the locking member could contact, abut and/or engage at least a portion of the hinge to help keep the hinge in a generally fixed position and thus keep the table top unfolded. The locking member may be moved back to the unlocked position in which the hinge may freely move to the hinge's first position as the table top folds. If desired, a leg (such as the legs 14, 16, 18, 20) may be sized and configured to help move the locking member between the unlocked and locked positions. For example, the leg and the locking member may be movably interconnected and moving the leg to the extended or use position may move the locking member to the locked position. In addition, moving the leg to the collapsed or storage position may move the locking member to the unlocked position. The leg and the locking member may be connected using one or more connectors, such as a link and/or other suitable structure. In greater detail, a first end of a connector may be pivotally or otherwise movably connected to the leg and a second end of the connector may be pivotally or otherwise movably connected to the locking member. The locking member may include one or more receiving portions, such as openings, that are sized and configured to receive a pin, push button or other structure to help releasably secure the locking member in a generally fixed position, such as in the locked position and/or the unlocked position. Desirably, this may help releasably secure the table top 12 in an unfolded position and/or may help releasably secure the leg in the use or storage positions. For instance, the table 10 may include first and second locking members and first and second legs, which may help move the first and second locking members to and from a locked position in which the first and second locking members may restrict the movement of first and second hinges and thus prevent the table top 12 from unintentionally unfolding.

As mentioned above, the table 12 and the table top sections 22, 24 may be constructed from plastic, preferably using a blow-molding process. Advantageously, this may allow a lightweight table top 12 to be easily constructed and it may allow the table top to be formed into various desired configurations, shapes, sizes and designs. This may also allow a table top 12 to be constructed that is generally weather resistant and temperature insensitive, which may allow the table to be used in a wide variety of locations and environments. In addition, this may allow a table top 12 that is durable, long-lasting and corrosion resistant to be constructed. Further, because a table top 12 constructed from blow-molded plastic may be relatively strong, the table 10 may be used to support a relatively large amount of weight. Significantly, a table top 12 constructed from blow-molded plastic may also form a structural member of the table, but the table top may be supported by other structures, such as the frame 34.

Advantageously, a table top 12 constructed from blow-molded plastic may be relatively strong because it includes opposing walls or surfaces that are separated by a distance. The opposing walls may help create a high-strength, rigid table top. In addition, because the interior portion of the table top 12 may be generally hollow, that may create a lightweight table top. Thus, the blow-molded table top 12 may be both lightweight and strong. It will be appreciated, however, that the table top 12 need not be constructed using plastic or a blow-molding process and may be constructed from plastic, metal, wood and/or other materials using other processes.

The legs 14, 16, 18, 20; the leg assemblies 26, 28; the frame 34; the rails 36, 38; and the rail sections 40, 42, 44, 46 are preferably constructed from metal, such as metal tubes. Desirably, the metal tubes may be relatively strong, yet lightweight. It will be appreciated, however, that the legs 14, 16, 18, 20; the leg assemblies 26, 28; the frame 34; the rails 36, 38; and the rail sections 40, 42, 44, 46 do not require a tubular configuration and may be constructed from other suitable materials. It will also be appreciated that the table 10 does not require any of these components depending, for example, upon the particular configuration of the table.

As discussed above, the table top 12 may include movable table top sections 22, 24 and may be foldable. The table top 12, however, need not include movable sections and need not be foldable. In fact, the table top 12 may have a unitary, one-piece construction formed, for example, during a blow-molding or other suitable manufacturing process. Likewise, the crossbars 30, 32 need not include movable sections and need not be foldable and may have a unitary, one-piece construction, if desired.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A fold-in-half table that is capable of being moved between a use position and a collapsed position, the fold-in-half table comprising:

a table top including a first portion and a second portion that are sized and configured to move between an unfolded position and a folded position about an axis; and a leg assembly having a generally U-shaped configuration, the leg assembly being sized and configured to be rotated relative to the table top between a locked position and an unlocked position, the leg assembly comprising:

a crossbar including a first portion connected to the first portion of the table top and a second portion connected to the second portion of the table top, the crossbar sized and configured to rotate relative to the table top along an axis;

a hinge connecting the first portion and the second portion of the crossbar, the hinge rotating with the first portion and the second portion of the crossbar when the crossbar is rotated relative to the table top, the hinge being sized and configured to allow the crossbar to move between an extended position and a collapsed position about an axis, the hinge capable of moving between the extended and collapsed positions when the axis of rotation of the hinge is generally aligned with the axis of rotation of the first and second portions of the table top;

a first leg connected to the first portion of the crossbar; and a second leg connected to the second portion of the crossbar;

wherein the first leg and the second leg extend away from the table top when the leg assembly is in the locked position to facilitate use of the table; and wherein the first leg and the second leg are disposed at least proximate the table top when the leg assembly is in the locked position to facilitate positioning the table top in the collapsed position;

wherein when the table top is in the unfolded position and the leg assembly is in the locked position, then the axis of rotation of the hinge is not aligned with the axis of rotation of the table top and that prevents movement of the table top from the unfolded position into the folded position and movement of the crossbar from the extended position to the collapsed position; and wherein when the leg assembly is in the unlocked position, then the axis of rotation of the hinge is aligned with the axis of rotation of the table top and the table top can be moved between the folded and unfolded positions and the crossbar can be moved between the extended and collapsed positions.

2. The fold-in-half table as in claim 1, wherein the rotational axis of the hinge is generally disposed at a right angle relative to the rotational axis of the table top when the leg assembly is in the locked position.

3. The fold-in-half table as in claim 1, wherein the rotational axis of the hinge and the rotational axis of the table top are the same when the leg assembly is in the unlocked position.

4. The fold-in-half table as in claim 1, wherein the first leg and the second leg rotate with the crossbar when the leg assembly is moved between the locked position and the unlocked position.

5. The fold-in-half table as in claim 1, wherein, when the hinge is in the extended position and the leg assembly is in the locked position, the leg assembly prevents the table top from being moved from the unfolded position to the folded position.

6. The fold-in-half table as in claim 1, further comprising a first bracket connected to the first portion of the table top and a second bracket connected to the second portion of the table top, the first portion of the crossbar being connected to the first bracket and the second portion of the crossbar being connected to the second bracket.

7. The fold-in-half table as in claim 1, further comprising a first side rail connected to the first portion of the table top and a second side rail connected to the second portion of the table top, the first leg being pivotally connected to the first side rail and the second leg being pivotally connected to the second side rail.

8. The fold-in-half table as in claim 1, further comprising a first bracket connected to the first portion of the table top, a second bracket connected to the second portion of the table top, a first side rail connected to the first portion of the table top, a second side rail connected to the second portion of the table top, the leg assembly being pivotally connected to the first side rail by the first bracket and being pivotally connected to the second side rail by the second bracket.

9. The fold-in-half table as in claim 1, further comprising a clip connected to the first portion of the crossbar and the second portion of the crossbar when the table top is in the collapsed position to help secure the table in the collapsed position.

10. The fold-in-half table as in claim 1, further comprising a first side rail connected to the first portion of the table top and a second side rail connected to the second portion of the table top, the first side rail including an offset portion that is pivotally connected to the leg assembly, the second side rail including an offset portion that is pivotally connected to the leg assembly.

11. The fold-in-half table as in claim 1, further comprising a first side rail connected to the first portion of the table top, a second side rail connected to the second portion of the table top, a first bracket connecting the leg assembly and the first side rail, a second bracket connecting the leg assembly and the second side rail, a first brace connecting the first side rail and the leg assembly, and a second brace connecting the second side rail and the leg assembly.

12. A fold-in-half table that is capable of being moved between a use position and a collapsed position, the fold-in-half table comprising:

a table top including a first section and a second section that are sized and configured to move between a folded position and an unfolded position about an axis of rotation, the unfolded position including an upper surface of the first section begin disposed in generally the same plane as an upper surface of the second section;

a leg assembly including a crossbar with a first section and a second section, the first section of the crossbar being connected to the first section of the table top and the second section of the crossbar being connected to the second section of the table top, the cross bar sized and configured to rotate relative to the table top along an axis, the leg assembly including a hinge assembly connecting the first section and the second section of the crossbar, the hinge assembly rotating with the first portion and the second portion of the crossbar when the crossbar is rotated relative to the table top, the hinge assembly being sized and configured to allow the crossbar to be moved between an extended position and a collapsed position about an axis of rotation, the hinge assembly capable of moving between the extended and collapsed positions when the axis of rotation of the hinge assembly is generally aligned with the axis of rotation of the first and second sections of the table top, the leg assembly being rotatable relative to the table top between a first position in which at least one leg extends outwardly from the table top to facilitate use of the table and a second position in which the leg is disposed at least proximate the table top;

wherein when the axis of rotation of the hinge assembly is generally aligned with the axis of rotation of the table top, the crossbar can be moved between the extended position and the collapsed position;

wherein when the axis of rotation of the hinge assembly is generally aligned with the axis of rotation of the table top, the table top can be moved between the folded position and the unfolded position;

wherein when the axis of rotation of the hinge assembly is not aligned with the axis of rotation of the table top, the crossbar cannot be moved between the extended position and the collapsed position; and wherein when the axis of rotation of the hinge assembly is not aligned with the axis of rotation of the table top, the table top cannot be moved between the folded position and the unfolded position.

13. The fold-in-half table as in claim 12, further comprising a first leg connected to a distal end of the first section of the crossbar and a second leg connected to a distal end of the second section of the crossbar, the first leg and the second leg being rotatable with the crossbar between the first position and the second position of the leg assembly, the first position including the first leg and the second leg extending outwardly from the table top to facilitate use of the table, the second position including the first leg and the second leg disposed at least proximate the table top to facilitate positioning the table in the collapsed position.

14. The fold-in-half table as in claim 13, wherein when the leg assembly is in the first position, the axis of rotation of the hinge assembly is not aligned with the axis of rotation of the table top and the crossbar cannot be moved between the extended position and the collapsed position, which prevents the table top from being moved from the unfolded position to the folded position.

15. The fold-in-half table as in claim 12, further comprising a first leg connected to a distal end of the first section of the crossbar and a second leg connected to a distal end of the second section of the crossbar;

wherein the leg assembly is movable between a use position in which the first leg and the second leg extend outwardly and away from the table top and a collapsed position in which the first leg and the second leg are disposed at least proximate a lower surface of the table top.

16. The fold-in-half table as in claim 12, further comprising a frame including a first side rail connected to the first section of the table top and a second side rail connected to the second section of the table top, the first section of the leg assembly being pivotally connected to the first side rail and the second section of the leg assembly being pivotally connected to the second side rail.

17. A fold-in-half table that is capable of being disposed in a use position and a collapsed position, the fold-in-half table comprising:

a table top with a first section and a second section that are sized and configured to be moved between a folded position and an unfolded position about an axis of rotation;

a first leg assembly that is movable between a use position and a collapsed position relative to the table top, the first leg assembly comprising:

a crossbar including a first section that is rotatably connected to the first portion of the table top and a second section that is rotatably connected to the second portion of the table top, the crossbar sized and configured to rotate relative to the table top along an axis;

a hinge connecting the first section and the second section of the crossbar to allow the first section and the second section of the crossbar to be moved between an extended position and a collapsed position about an axis of rotation, the hinge rotating with the first section and the second section of the crossbar when the crossbar is rotated relative to the table top, the hinge capable of moving between the extended and collapsed positions when the axis of rotation of the hinge is generally aligned with the axis of rotation of the first and second sections of the table top;

a first leg connected to the first section of the crossbar; and a second leg connected to the second section of the crossbar;

wherein, when the first leg and the second leg extend outwardly and away from the table top, the axis of rotation of the hinge is disposed at generally a right angle relative to the axis of rotation of the table top to prevent the crossbar from being moved from the extended position to the collapsed position and to prevent the table top from being moved from the unfolded position to the folded position; and wherein, when the first leg and the second leg are generally disposed proximate the table top, the axis of rotation of the hinge is generally aligned with an axis of rotation of the table top to allow the crossbar to be moved between the extended position and the collapsed position and to allow the table top to be moved between the unfolded position and the folded position;

a second leg assembly that is movable between a use position and a collapsed position relative to the table top, the second leg assembly comprising:

a crossbar including a first section that is rotatably connected to the first portion of the table top and a second section that is rotatably connected to the second portion of the table top;

a hinge connecting the first section and the second section of the crossbar to allow the first section and the second section of the crossbar to be moved between an extended position and a collapsed position about an axis of rotation;

a first leg connected to the first section of the crossbar; and a second leg connected to the second section of the crossbar;

wherein, when the first leg and the second leg extend outwardly and away from the table top, the axis of rotation of the hinge is disposed at generally a right angle relative to the axis of rotation of the table top to prevent the crossbar from being moved from the extended position to the collapsed position and to prevent the table top from being moved from the unfolded position to the folded position; and wherein, when the first leg and the second leg are generally disposed proximate the table top, the axis of rotation of the first hinge is generally aligned with an axis of rotation of the table top to allow the crossbar to be moved between the extended position and the collapsed position and to allow the table top to be moved between the unfolded position and the folded position;

a first rail connected to the first section of the table top, the first leg assembly being pivotally connected to the first side rail and the second leg assembly being pivotally connected to the first side rail; and a second rail connected to the second section of the table top, the first leg assembly being pivotally connected to the second side rail and the second leg assembly being pivotally connected to the second side rail.

18. The fold-in-half table as in claim 17, wherein the first leg assembly has a generally U-shaped configuration with the first leg disposed at least proximate one end of the crossbar and the second leg disposed at least proximate another end of the crossbar; and wherein the second leg assembly has a generally U-shaped configuration with the first leg disposed at least proximate one end of the crossbar and the second leg disposed at least proximate another end of the crossbar.

19. The fold-in-half table as in claim 17, wherein the first leg and the second leg of the first leg assembly rotate with the crossbar when the first leg assembly is moved between the use and the collapsed positions; and wherein the first leg and the second leg of the second leg assembly rotate with the crossbar when the second leg assembly is moved between the use and the collapsed positions.

20. The fold-in-half table as in claim 17, further comprising a first bracket connecting the first leg assembly to the first side rail, a second bracket connecting the first leg assembly to the second side rail, a third bracket connecting the second leg assembly to the first side rail, and a fourth bracket connecting the second leg assembly to the second side rail.

* * * * *

UNITED STATES PATENT AND TRADEMARK OFFICE

CERTIFICATE OF CORRECTION

PATENT NO. : 7,707,949 B2
APPLICATION NO. : 12/126615
DATED : May 4, 2010
INVENTOR(S) : Larcom et al.

It is certified that error appears in the above-identified patent and that said Letters Patent is hereby corrected as shown below:

On Page 2, in Field (56), under "OTHER PUBLICATIONS", in Column 2, Line 11, delete "onPatentability" and insert -- on Patentability --, therefor.

In the Specification:

In Column 2, Line 13, after "folded-in-half" insert -- folded-in-half. --, therefor.

In Column 7, Line 42, delete "FIG. 1 1," and insert -- FIG. 11, --, therefor.

Signed and Sealed this
Eleventh Day of September, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,707,949 B2
APPLICATION NO. : 12/126615
DATED : May 4, 2010
INVENTOR(S) : Larry Larcom et al.

It is certified that error appears in the above-identified patent and that said Letters Patent is hereby corrected as shown below:

IN THE CLAIMS

In Column 14, Line 34, delete “locked” and insert -- unlocked --, therefor.

Signed and Sealed this
Fifth Day of January, 2016

Michelle K. Lee

Michelle K. Lee
*Director of the United States Patent and Trademark Office*